United States Patent [19]

Nerenberg et al.

[11] 4,005,815

[45] Feb. 1, 1977

[54] CARTON WITH SELF-CONTAINED REINFORCED HANDLE

[75] Inventors: Robert W. Nerenberg, Middletown; Frank B. Herzog, Cincinnati, both of Ohio

[73] Assignee: The Interstate Folding Box Company, Middletown, Ohio

[22] Filed: Feb. 19, 1976

[21] Appl. No.: 659,375

[52] U.S. Cl. ..... 229/52 B; 229/38

[51] Int. Cl.[2] ..... B65D 5/46; B65D 25/28

[58] Field of Search ..... 229/38, 39 R, 52 B, 229/45

[56] References Cited

UNITED STATES PATENTS

| | | | |
|---|---|---|---|
| 632,222 | 8/1899 | Malatesta | 229/38 |
| 2,013,874 | 9/1935 | Whalley | 229/52 B |
| 2,163,963 | 6/1939 | Poppe | 229/54 R X |
| 2,331,754 | 10/1943 | Wohlene | 229/45 X |
| 2,652,970 | 9/1953 | George | 229/52 B X |
| 2,764,336 | 9/1965 | White | 229/45 X |
| 2,802,615 | 8/1957 | Radke | 229/52 B |
| 3,194,475 | 7/1965 | Ralston | 229/38 |
| 3,403,839 | 10/1968 | Farquhar | 229/52 B X |

FOREIGN PATENTS OR APPLICATIONS

| | | | |
|---|---|---|---|
| 1,464,029 | 11/1966 | France | 229/52 B |

*Primary Examiner*—Davis T. Moorhead

*Attorney, Agent, or Firm*—Melville, Strasser, Foster & Hoffman

[57] ABSTRACT

A one-piece paperboard carton for relatively heavy articles, the carton having a reclosable top closure and a self-contained carrying handle formed in one of its body walls, the body wall in which the handle is formed being reinforced in the area of the handle by a plurality of thicknesses of paperboard one of which comprises a flap extension carried by one of the top closure flaps, means being provided to secure the flap extension in handle reinforcing position when the top closure is in the fully closed position.

7 Claims, 10 Drawing Figures

CARTON WITH SELF-CONTAINED REINFORCED HANDLE

BACKGROUND OF THE INVENTION

The present invention relates to paperboard cartons, and more particularly to cartons adapted to package contents which are relatively heavy. In order that such packages may be conveniently carried by the consumer, various types of carrying handles have hitherto been proposed. For the most part, such handles have been unsatisfactory in that they interfere with the stacking of the cartons, and in many instances the handles are unsatisfactory in that they do not adequately support the weight load of the carton and are subject to breaking and tearing. This is particularly true of handles which are integrally formed with the cartons. Other types of handles, such as plastic straps or wire bails, add to the cost of the carton and, if detachable, can be readily lost.

Another disadvantage of most cartons which are provided with carrying handles, whether integral with the carton or detachably connected to it, is that their carrying function is destroyed or badly impaired once the carton has been opened. Many such cartons rely on the engagement of the handle with the closed and sealed top closure of the carton to sustain and support the weight of the contents, but once the sealed end closure flaps have been opened, the handle and end closure are no longer capable of sustaining the weight of the carton should only a portion of the contents be removed, or should it be desired to continue to use the carton to store its contents subsequent to initial opening of the carton for display or inspection of its contents.

In contrast to the prior art constructions, the present invention provides a reclosable carton having an integral reinforced handle by means of which the carton may be conveniently carried irrespective of whether or not the carton has been opened, the handle being contained within the confines of one of the carton body walls so that the carton is free from external projections which would interfere with the stacking of the cartons.

SUMMARY OF THE INVENTION

In accordance with the present invention, the carton structure, including the handle and its reinforcement, is formed from a cut and scored paperboard blank which requires no more board than would be employed in forming a carton with conventional end closures. The carton blank has enclosing body walls in side-by-side articulation together with a longitudinal glue flap for joining the body walls together to form a tubular body. The bottom closure flaps may be of any conventional construction, such as contentional seal-end flaps, or they may be of the tuck-in variety, or they may comprise a so-called automatic bottom in which the flaps will be automatically erected to form the bottom of the carton upon the erection of the carton body walls from the flat-folded to the squared-up condition.

The carrying handle is formed in one of the carton body walls a short distance below its uppermost edge, preferably by die-cutting a hand hole forming tab in the body wall, which tab is foldable inwardly and upwardly to provide reinforcement for the area of the body wall lying immediately above the hand hole opening. The carton top closure includes at least one full width closure flap having a flap extension extending along its free side edge adapted to be juxtaposed to the inner surface of the body wall in which the hand hole opening is formed, the extension overlying the hand hole opening and coacting with the infolded hand hole defining tab to further reinforce the handle.

In one embodiment of the invention the handle may be further reinforced by utilizing the end closure flap connected to the body wall in which the hand hole opening is formed as an additional handle reinforcement, the flap being adapted to be infolded and adhered to the inner surface of the carton body wall. Preferably, the infolded flap will also contain a mating hand hole defining tab so that, in the assembled structure, the handle forming opening will be reinforced by five thicknesses of board.

It is also contemplated to provide means for maintaining the extension carrying full width top closure flap in its closed position. In one embodiment of the invention, such means comprise abutment forming lines of cut extending inwardly from the opposite ends of the extension at its line of articulation to the full width closure flap, the end edges of the extension when in the closed position engaging beneath the adjoining edges of the adjacent closure flaps to lock the full width flap in the closed position. In an alternative embodiment, a second full width closure flap is hingedly connected to the upper edge of the body wall in which the handle is formed, the second full width closure flap overlying the first flap and acting to maintain the first full width closure flap and its extension in the closed position.

DESCRIPTION OF THE PREFERRED EMBODIMENTS

Figure 1:
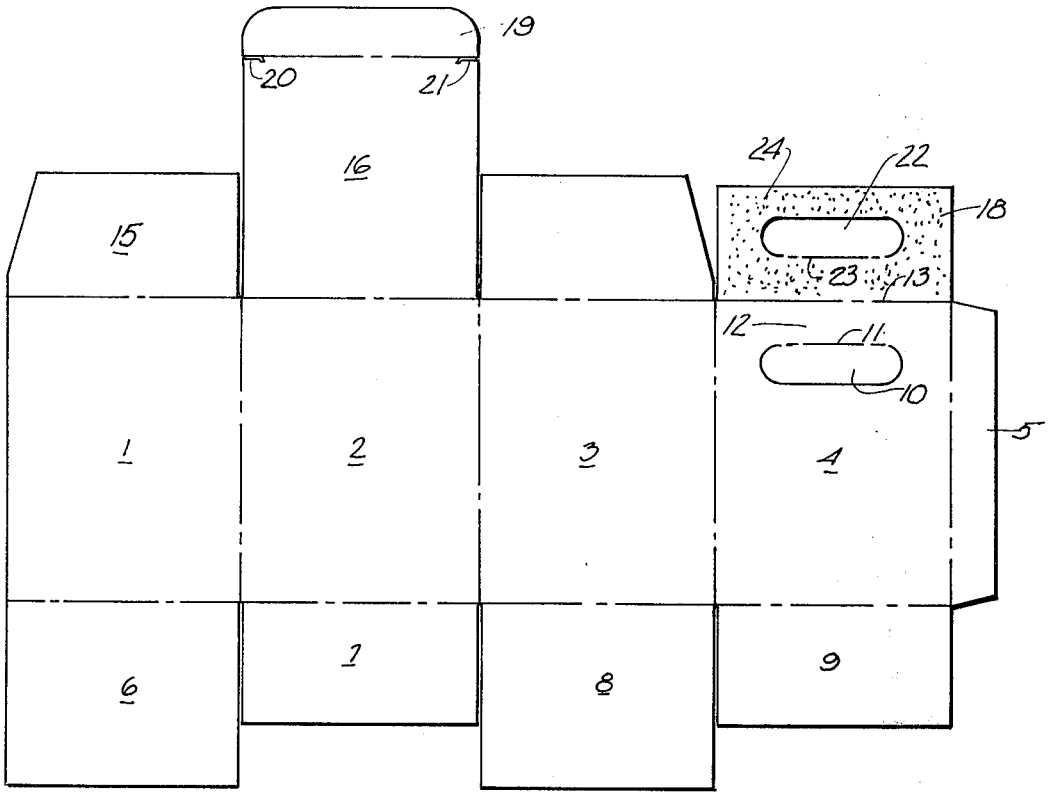
FIG. 1 is a plan view of a cut and scored blank for forming a carton structure in accordance with the invention.

Referring first to FIG. 1 of the drawings which illustrates the carton blank for forming one embodiment of the invention, the blank comprises body walls 1, 2, 3 and 4 in side-by-side articulation in the order named, the body wall 4 having a glue flap 5 extending lengthwise along its outermost side edge. In this embodiment, the bottom closure is formed from conventional seal end closure flaps 6, 7, 8 and 9 hingedly connected to the bottom edges of body walls 1, 2, 3 and 4, respectively.

A hand hole forming tab 10 is die-cut in body wall 4, the tab being hingedly connected to the body wall along a line of articulation 11 defining the uppermost side edge of the tab. Thus, the area 12 lying between the line of articulation 11 and the adjacent end edge 13 of wall 4 is constituted a self-contained carrying handle for the carton. Preferably, the width of tab 10 will be substantially equal to the width of area 12, i.e., the distance between line of articulation 11 and the end edge 13 of body wall 4, so that the tab 10 will serve as a reinforcement for the area 12 when the tab is infolded, as will be explained in greater detail hereinafter.

Figure 2:
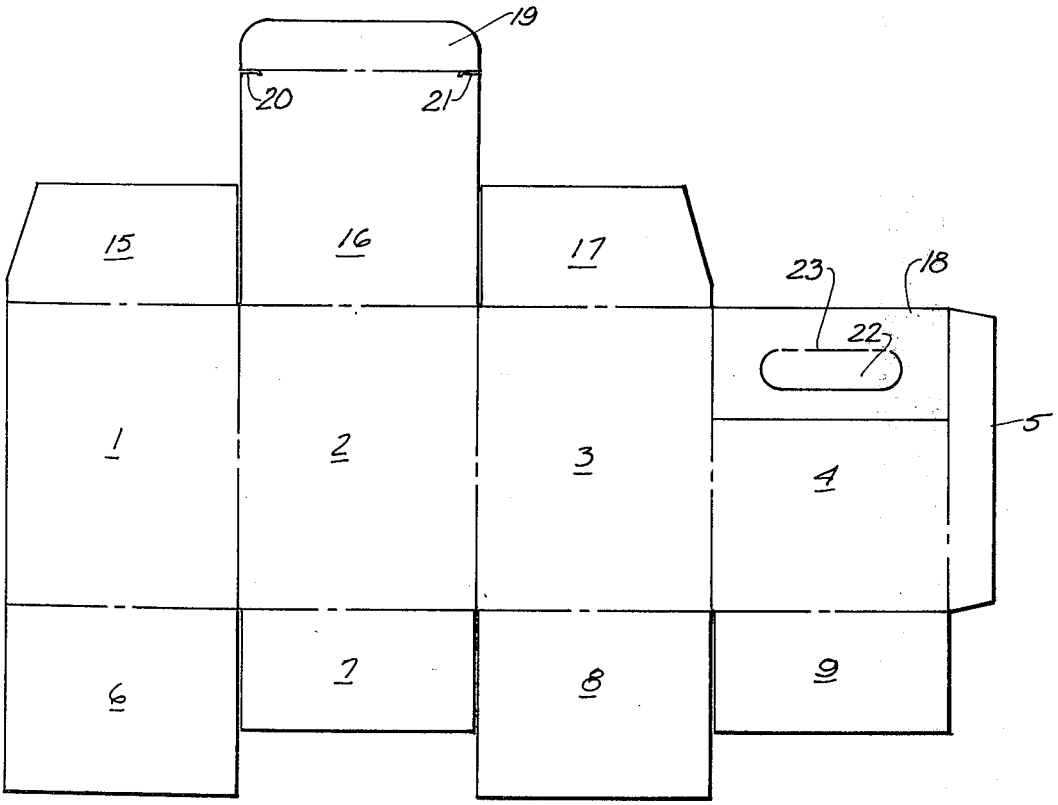
FIG. 2 is a plan view similar to FIG. 1 but showing the initial step in the assembly of the blank, which is the infolding of the top closure flap carrying a mating hand hole forming tab.
Figure 3:
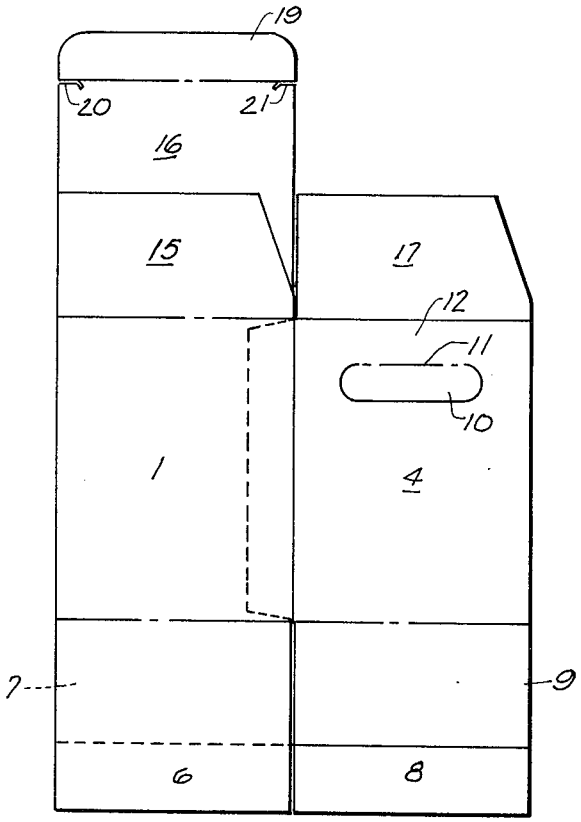
FIG. 3 is a plan view illustrating the carton blank in its knocked-down flat-folded condition.

The top closure is composed of end closure flaps 15, 16, 17 and 18, the closure flap 16 being a full width closure flap and having a tuck extension 19 hingedly connected to its outermost side edge, the extension having abutment defining lines of cut 20 and 21 extending inwardly from its opposite end edges. In the embodiment illustrated, the flap 18, instead of being used as a conventional closure flap, is utilized as a handle reinforcing member; to this end, the flap 18 is provided with a hand hole forming tab 22 adapted to mate with the hand hole forming tab 10, the tab 22 being hingedly connected to the flap 18 along the line of articulation 23. Adhesive, indicated at 24, will be applied to the flap 18 in areas surrounding the tab 22, whereupon the flap 18 will be infolded to the position illustrated in FIG. 2, in which position it will be adhesively secured to the inner surface of the body wall 4 with the tab 22 in registry with tab 10. The carton blank is then folded to the condition illustrated in FIG. 3, in which the glue flap 5 is juxtaposed to the overlying marginal side edge of body wall 1, with the interposition of adhesive therebetween to form a knocked-down flat-folded carton.

Figure 4:
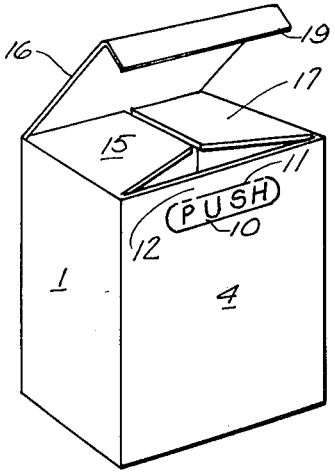
FIG. 4 is a perspective view of the carton structure in erected condition prior to the infolding of the full width top closure flap.
Figure 6:
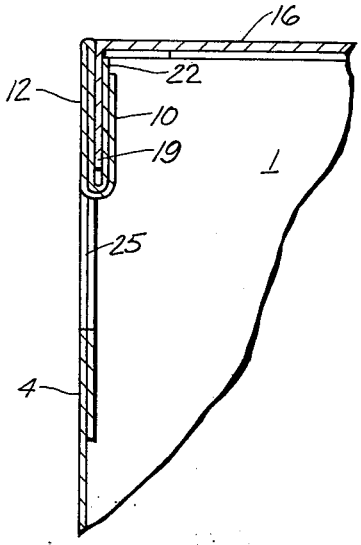
FIG. 6 is an enlarged vertical sectional view taken along the line 6—6 of FIG. 5.
Figure 5:
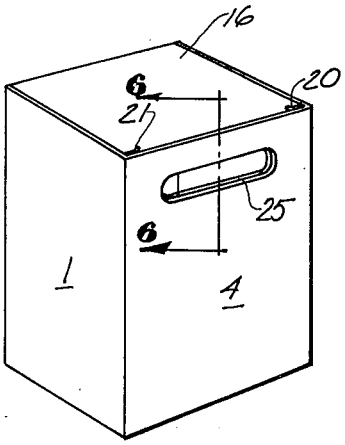
FIG. 5 is a perspective view similar to FIG. 4 illustrating the carton in its fully closed position.

The carton blank will be erected and its bottom end closure sealed in conventional fashion, whereupon the contents may be placed in the carton and the top closure flaps infolded to complete the assembly of the carton. FIG. 4 illustrates the top closure in partially infolded condition. As the full width closure flap 16 is infolded, the extension 19 will be tucked between the body wall 4 and the adjoining end edges of closure flaps 15 and 17 and hence will be juxtaposed to the inner surface of reinforcing flap 18 in the handle defining area 12. To this end, the extension 19 will have a width no greater than the width of area 12. FIG. 5 illustrates the top closure in the fully closed position. As will be understood by the worker in the art, the abutment defining lines of cut 20 and 21 will free the end edges of the extension 19 to engage beneath the adjacent end edges of the closure flaps 15 and 17, thereby locking the full width closure flap in place. When it is desired to carry the carton, the tab 10 will be folded inwardly and upwardly, carrying the underlying tab 22 with it, thereby defining the hand hole opening 25, seen in FIG. 5. As will be apparent from FIG. 6, when the tabs 10 and 22 are folded inwardly and upwardly they will fold around reinforcing extension 19, thereby providing five thicknesses of board in the handle area 12. Such arrangement permits the handle to sustain a heavy weight load without tearing or peeling.

Figure 7:
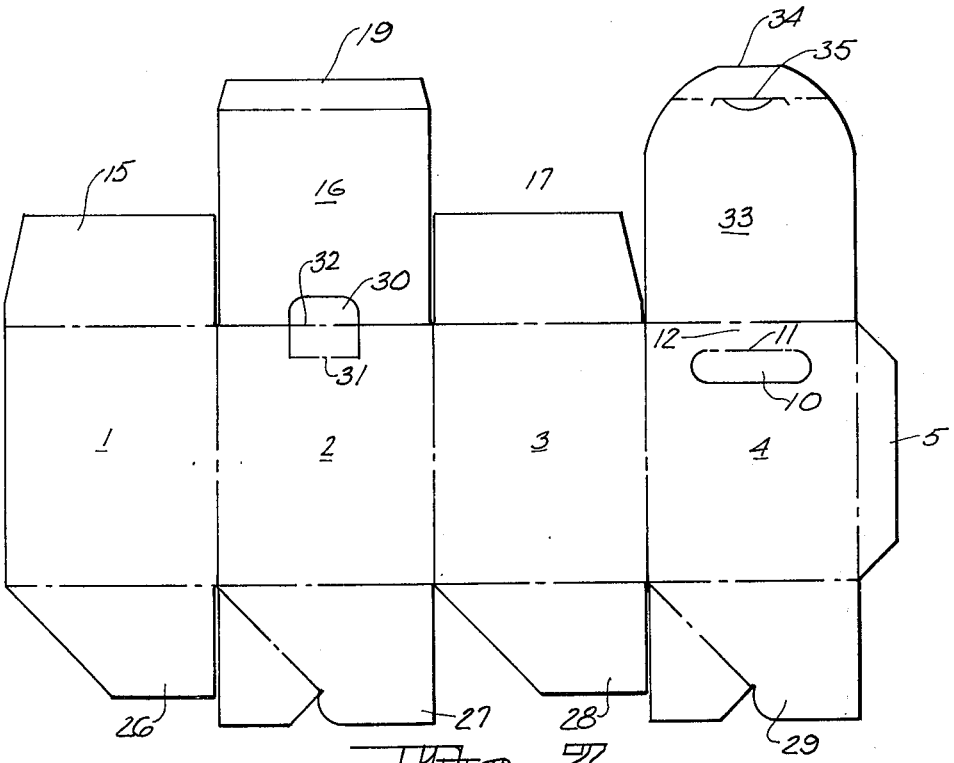
FIG. 7 is a plan view of a cut and scored blank for forming a modified carton structure in accordance with the invention.

Referring next to FIG. 7, which illustrates a modification of the invention wherein like body parts have been given like reference numerals, the bottom closure flaps in this instance comprise flap members 26, 27, 28 and 29 which when infolded and secured together form a socalled automatic bottom which is self-erecting along with the carton body walls in a manner which will be understood by the worker in the art. Top closure flaps 15, 16 and 17 are essentially identical to the previous embodiment, including the provision of extension 19 on the full width closure flap 16. However, in this instance, a locking tongue 30 is formed in part in closure flap 16 and in part in underlying body wall 2, the locking tongue being hingedly connected to body wall 2 along the line of articulation 31, the tongue being additionally foldable along line 32 which coincides with the end edge of body wall 2. A full width end closure flap 33 is connected to the upper edge of body wall 4, the flap 33 having an extension 34 and a tongue receiving slot 35.

Figure 8:
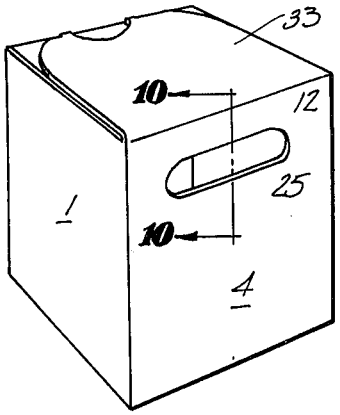
FIG. 8 is a perspective view of the erected and closed carton formed from the blank of FIG. 7, the view being taken from the handle forming side of the carton.
Figure 9:
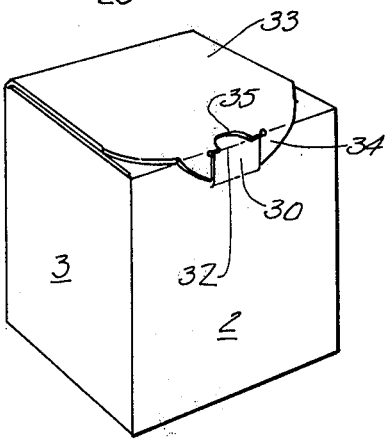
FIG. 9 is a perspective view of the erected carton of FIG. 8 taken from the side opposite the handle forming body wall.
Figure 10:
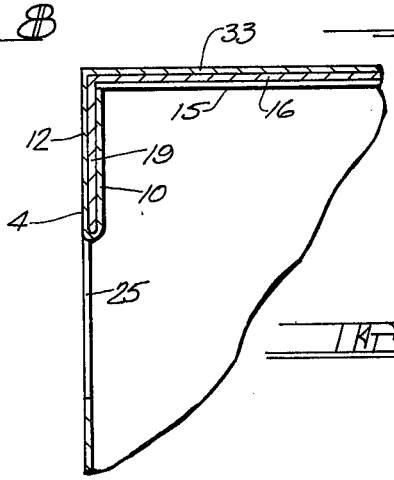
FIG. 10 is an enlarged vertical sectional view taken along the line 10—10 of FIG. 8.

When the carton blank illustrated in FIG. 7 is erected and closed, it will assume the position illustrated in FIGS. 8 and 9, the flaps 15 and 17 being the first infolded flaps, followed by the infolding of flap 16 with extension 19 tucked between the end edges of flaps 15 and 17 and the inner surface of body wall 4 in handle forming area 12. The flap 33 is the outermost or last folded flap and, as will be seen in FIG. 9, the extension 34 overlies the upper central portion of body wall 2 with the base portion of tongue 30 overlying extension 34 and its outermost portion, i.e., the portion extending beyond line 32, inserted in the tongue receiving slot 35. The flap 33 thus serves to securely lock the end closure with the underlying full width flap 16 securely held in the closed position with its extension 19 juxtaposed to the inner surface of body wall 4 in handle area 12. When the tab 10 is infolded to expose the handle opening 25, the parts will assume the condition illustrated in FIG. 10, in which it will be seen that a three thickness reinforced handle is provided.

As should now be evident, the instant invention provides a reclosable carton having a self-contained handle composed of from three to five thicknesses of board, which carton may be utilized to package contents which are of sufficient weight to require a handle for carrying purposes. The hand hole opening may remain closed to protect the contents of the carton until such time as it is desired to carry the carton by means of the handle, and consequently the contents are protected during storage and shipment. If it is desired to package particulate materials, such as powder or granular materials, they may be placed in a sealed bag of a size to fit within the carton, the size of the bag being such that sufficient room will be allowed to permit the hand hole defining tab or tabs to be folded inwardly when it is desired to carry the carton by its handle.

Modifications may be made in the invention without departing from its spirit and purpose, and a number of modifications have already been set forth and others will occur to the skilled worker in the art upon reading this specification. For example, in the embodiment of FIGS. 1–6, if the requirements of use do not require a five thickness handle, the hand hole forming tab 22 may be omitted and the flap 18 utilized as a conventional end closure flap. If the flap 18 is used to reinforce the handle, the tab 22 may be removed entirely to leave only a hand hole opening in the flap, thereby resulting in four thicknesses of board in the handle area. Accordingly, it is not intended that the invention be limited other than in the manner set forth in the claims which follow.

The embodiments of the invention in which an exclusive property or privilege is claimed are defined as follows:

1. In a one-piece paperboard carton having four enclosing body walls and end closures at the opposite ends of said body walls, a hand hole defining tab formed in a first of said body wall spaced downwardly from the upper edge thereof to define a handle portion therebetween, said tab being hingedly connected to said first body wall along a line of articulation defining the upper side edge of said tab, the top closure of said carton comprising a pair of flap members hingedly connected to the upper edges of the body walls adjacent said first body wall and a full width closure flap hingedly connected to the upper edge of the carton body wall opposite said first body wall, a tuck extension on the outermost side edge of said full width closure flap, said tuck extension having a width substantially equal to the width of the handle defining portion of said first body wall, whereby when said full width flap is fully closed and the tuck extension juxtaposed to the inner surface of said first body wall, said tuck extension will reinforce the handle defining portion thereof, said tab being foldable inwardly and upwardly to contact the inner surface of said tuck extension to provide further reinforcement for said handle defining portion, and releasable locking means for maintaining said full width closure flap and said tuck extension in their fully closed position.

2. The paperboard carton claimed in claim 1 including a flap member hingedly connected to the upper edge of said first body wall, said last named flap member being infolded and secured to the inner surface of said first body wall in the area of said handle defining portion to provide further reinforcement for said handle portion.

3. The paperboard carton claimed in claim 2 wherein the flap member hingedly connected to said first body wall is of a size to overlie and cover the hand hole defining tab in said first wall, and a mating hand hole defining tab in said last named flap member, said tabs being jointly foldable inwardly and upwardly to reinforce said handle portion.

4. The paperboard carton claimed in claim 3 wherein said releasable locking means comprises abutment defining lines of cut extending inwardly from the opposite end edges of said tuck extension along its line of attachment to said full width closure flap.

5. The paperboard carton claimed in claim 1 including a second full width closure flap hingedly connected to the upper edge of said first body wall, said second full width closure flap being adapted to overlie and cover said first named full width closure flap, and wherein said releasable locking means engages said second full width closure flap.

6. The paperboard carton claimed in claim 5 wherein said releasable locking means comprises a tongue member hingedly connected to the carton body wall opposite said first body wall, said tongue member being engageable with said second full width closure flap when in its fully closed position.

7. The paperboard carton claimed in claim 6 wherein said second fully width closure flap has an extension on its outermost side edge foldable to lie along the upper marginal edge of the body wall opposite said first body wall, and a tongue receiving slot lying along the line of connection between said second fully width closure flap and its extension.

* * * * *